US005243726A

United States Patent [19]

Bisbee

[11] Patent Number: 5,243,726

[45] Date of Patent: Sep. 14, 1993

[54] MATTRESS TILTING ASSEMBLY

[76] Inventor: Rex E. Bisbee, 8518 Spartan Rd., Fairfax, Va. 22031

[21] Appl. No.: 955,428

[22] Filed: Oct. 2, 1992

[51] Int. Cl.[5] ..... A61G 7/00

[52] U.S. Cl. ..... 5/610; 5/509.1

[58] Field of Search ..... 5/509.1, 610

[56] References Cited

U.S. PATENT DOCUMENTS

| | | | |
|---|---|---|---|
| 964,105 | 7/1910 | Hogan et al. | 5/610 |
| 2,303,433 | 12/1942 | Caldwell et al. | 5/610 |
| 3,259,921 | 7/1966 | Alsobrook, Jr. | 5/610 |
| 4,118,811 | 10/1978 | Degen | 5/610 |
| 4,715,073 | 12/1987 | Butler | 5/509.1 X |
| 4,856,129 | 8/1989 | Butler | 5/509.1 X |

*Primary Examiner*—Michael F. Trettel

*Attorney, Agent, or Firm*—William H. Holt

[57] ABSTRACT

A mattress tilting assembly having upper and lower support frames. The upper support frame is designed to carry a conventional box-spring and mattress and is pivoted to the lower support frame so that the head portion of the mattress is raised higher than the foot portion. Lock means are positioned between the upper and lower frames for providing stability when the upper frame is in a raised position. The lock means includes at least one brace member pivoted to the upper frame and having a nose portion disposable within and passing through a slot located in the lower frame for securely holding the upper frame in raised position. Means are also provided so that the frame members may be adjusted to accommodate mattresses of different widths.

4 Claims, 2 Drawing Sheets

MATTRESS TILTING ASSEMBLY

BACKGROUND OF THE INVENTION

1. Field of the Invention

The present invention relates to mattress tilting devices, and more particularly to an improved mattress tilting assembly which enables movement of the mattress from a horizontal position to an inclined position (and back) with a minimum lifting effort.

2. Brief Description of the Prior Art

There is a great need for devices which facilitate the repeated raising and lowering of mattresses, particularly in the home environment by persons of little or limited strength, as for example by a nurse, or an elderly spouse or friend. Among the many conditions which dictate the necessity of a "patient" having an inclined bed surface are physical problems related to or associated with dizziness (vertigo), digestion, hypertension and respiratory (breathing) difficulties. Elevation of the head and upper body in bed is often recommended medically as a means of alleviating physical difficulties associated with these illnesses an achieving greater physical comfort. Devices which facilitate inclination of mattresses are often used by others in the custodial care of individuals at home. Thus, the need for inclinable beds can be viewed as having great significance in the home care environment, so that with or without medical advice, those persons afflicted with the common ailments identified above can achieve the personal relief and comfort desired.

In the home environment, desired degrees of mattress inclination have been achieved in various makeshift ways, including placing objects (e.g., bricks, wooden blocks, books) under the headboard, or positioning similar objects directly under the springs or mattress. The procedure of obtaining the degree of inclination best suited for the "patient" is basically one of trial and error. Once the optimum angular orientation is achieved, the entire bed is usually tilted and is unstable and unsightly. Moreover, many of the known techniques of altering the inclination of the bed/mattress involve heavy lifting and risks of injury to the caretaker.

A number of bed assemblies and mattress constructions have been proposed to overcome the difficulties associated with the above-described methods of attaining the desired mattress inclination to meet the needs of the patient. By and large, the known conventional devices are large, unwieldy, overly complicated, unsightly in appearance and involve production costs and prices beyond the reach of many persons in need of such assemblies. Moreover, these known devices are not adaptable to the different size beds now in use. Still more importantly, some of these known devices require use in place of existing beds, thus dramatically altering the furnishings and room decor and contributing to furniture obsolesence.

There is therefore a long-felt and widespread need for an improved mattress tilting assembly which provides the desired degree of mattress inclination. Such a mattress tilting assembly, to be of greater benefit in the care of ailing patients than known existing bed frame assemblies, should exhibit the following features:

(1) The mattress tilting assembly (with legs removed) should fit into most existing bed frames for single or double size beds, and should be fashioned so as not to disturb the headboard and footboard where present;

(2) The mattress tilting assembly should be easily adjustable from a horizontal position into an inclined position, and should be just as easily returnable to a non-inclined, horizontal position when not in use.

(3) The mattress tilting assembly should be simply yet durably constructed, and be produced and sold at costs which permit purchase of such devices by the many patients who need it but heretofore could not afford it.

SUMMARY AND OBJECTS OF THE PRESENT INVENTION

It is therefore the principal object of the present invention to overcome all the deficiencies of the known mattress tilting assemblies while achieving all of the advantages described above.

Another object of the present invention is to provide a mattress tilting assembly which permits inclination of a mattress from a substantially horizontal position to a stable position of inclination without requiring great physical effort.

Still another object of the invention is to provide a simple, inexpensive mattress tilting assembly which permits the setting of the angular position of a mattress at an optimum inclined position.

These and other objects are achieved by the present invention by providing a mattress tilting assembly including a first width-adjustable frame assembly constructed of light-weight yet durable metal, and a second width-adjustable frame assembly. Desirably, the tilting assembly is constructed of a material which is light weight, and the assembly itself is compact, transportable, and installable and adjustable with minimum physical effort. The tilting assembly of the present invention is designed to fit into , and become incorporated within, the patient's bed presently in the home, utilizing the existing boxsprings and mattress, thereby disturbing neither the function of the bed nor the room decor.

The mattress tilting assembly of the present invention includes first and second frame units, both of which are adjustable in width and is therefore adaptable to single and double size boxsprings and mattresses. When the tilting assembly is not used for positioning a mattress on an incline, the frame units, together with the boxsprings and mattress, can be returned to the horizontal position. Moreover, when the mattress tilting assembly is disposed in the horizontal position, no part of the frame units are visible.

The mattress tilting assembly of the present invention is also simple in construction, durable, of minimum weight, and its cost of production is minimal, thereby enabling the widest possible affordability and use by persons who need this type of apparatus.

BRIEF DESCRIPTION OF THE DRAWINGS

These objects, advantages and features of the present invention will become apparent from the detailed description of the preferred embodiment which follows, when considered together with the appended drawings, in which:

FIG. 2 is a view from the left side of the assembly shown in FIG. 1 and shows a portion of a brace member disposed in a slot provided in the elongated frame member, and FIG. 3 is an end view of the brace member of FIG. 2.

DESCRIPTION OF PREFERRED EMBODIMENTS

Figure 1:
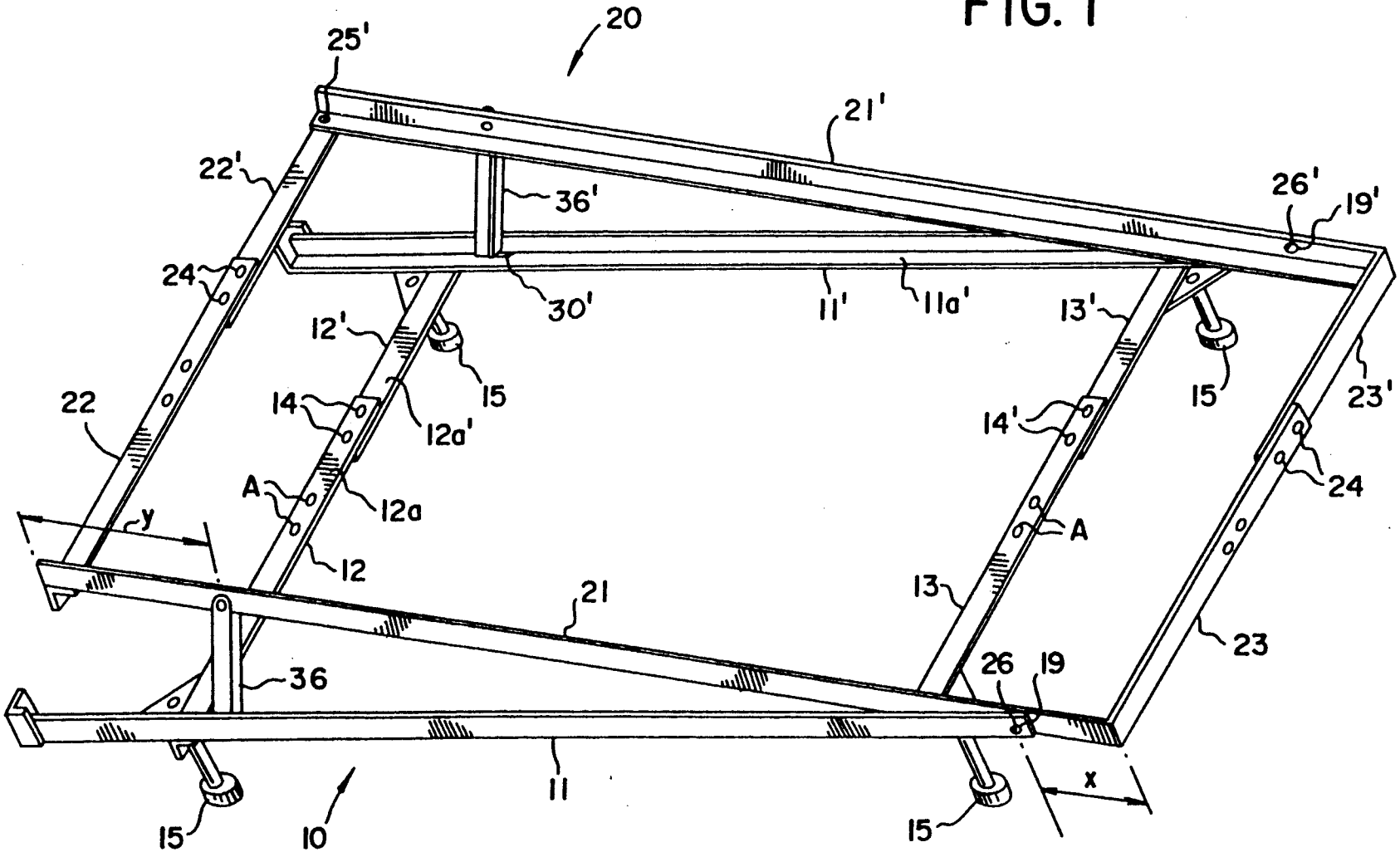
FIG. 1 is a perspective view of the improved tiltable bed frame assembly of the present invention showing first and second frame units disposed at an angle of inclination relative to one another.

Referring now to the drawings, and more particularly to FIG. 1, there is shown a mattress tilting assembly which includes a first "supporting" frame unit 10 and a second, tiltable, box spring and mattress supporting frame unit 20.

The first supporting frame unit 10 essentially comprises a rectangular support frame structure including first and second side members 11, 11' having at least a horizontally disposed support flange 11*a*, 11*a*' (and preferably having an L-shaped cross section), and first and second cross members 12,12' and 13,13', each having horizontal support surfaces 12*a*, 12*a*', respectively. The support flanges of the side members and the horizontal support surfaces of the cross members together define a planar support region for accommodating the second frame unit 20 when the latter is not disposed in its tilted position (to be described in more detail below). The end regions of the cross members associated with the side members are provided with sets of adjustment openings, and bolts 14, 14', which are disposed in and pass through overlapped sets of openings, are secured in place via nuts or other similar fasteners thereby affixing the cross members 12, 12' and 13, 13' to one another. It is to be noted that adjustability of the distance separating the two side members 11, 11', i.e., the width, is facilitated by providing at least one other set of openings in one of the cross members, as for example shown in members 12 and 13 at A in FIG. 1. Adjustability of the width dimension is a desirable feature insofar as it permits accommodation of different size boxsprings and mattresses.

A plurality of legs 15 may be attached to the first supporting frame unit 10 at appropriate locations, and may have casters, rug rollers or slides at their floor-engaging ends to facilitate movement of the supporting frame unit 10 across the surface of the floor. Desirably, the legs are of standard height, i.e. 8" or so. As a result, when the frame unit 10 is disposed horizontally, a bed of standard height can be obtained when a box spring and mattress of standard thickness are utilized.

The second frame unit 20, which is designed for supporting and retaining a box spring and mattress, essentially comprises a rectangular frame structure configured to fit within the perimeter, and atop the supporting flange or surfaces 11*a* and 11*a*' , of the first frame unit 10.

More specifically, the frame unit 20 comprises first and second side members 21, 21', each including a first cross arm 22 or 22' located at the head-supporting end of its side member, and a second cross arm 23 or 23' located at the opposite foot-supporting end of the side member. Each of the first and second arms extends in a direction substantially normal from its respective side member toward the other side member. In a manner similar to that described in reference to the first frame unit 10, the end regions of the first and second arms of the second frame unit side members are provided with sets of adjustment openings. Nut and bolt fastener assemblies 24, 24 are employed to secure the first and second arms together, with the bolts being inserted in and extending through overlapping sets of openings in the respectively engaged first and second arms of the side members 21, 21'. The plural sets of openings in the first and second arms provide width adjustability of the second frame unit 20 so that the width of both frame units can be simultaneously changed if another box spring size is to be employed, e.g., if the box spring is to be changed from full size to single size.

In one variation of the invention, each of the arms 22, 22' and 23, 23' may be joined to their respective side members at a pivoted juncture, as for example as shown at 25' in FIG. 1. This interconnection allows the arms to be pivoted into parallel alignment with their respective side members when it is necessary to dismantle and store the bed support frame assembly of the present invention.

The two frame units 10 and 20 are pivotally joined to one another at the openings 19, 26 and 19', 26' via bolts, pins, rivets or like fasteners. Openings 26,26' are disposed at a distance "x" from the second cross member 23,23' toward the first cross member 22,22'. Only one opening 26' is visible in FIG. 1 since opening 26 is hidden behind side member 21.

Because the first frame unit 10 and the second frame unit 20 are pivotally attached at locations other than at the extreme ends of their foot-supporting regions, the moment, and hence the force applied to the cross arm at the head supporting region, which is necessary to effect rotation of the second frame unit relative to the first frame unit, is substantially less than in the case where the two frame units are pivotally attached at the extreme ends of their respective foot supporting regions. In fact, by an appropriate choice of the distance "x", it is possible to provide a mattress tilting assembly in which the second frame unit can be rotated relative to the first frame unit with application of minimal effort.

Figure 3:
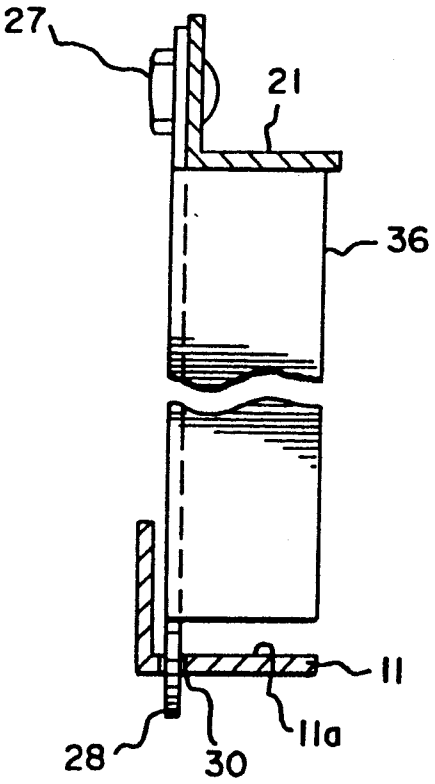
FIGS. 2 and 3 illustrate one of the brace members which may be used to maintain the frame units of the tiltable bed frame assembly in an inclined position. In particular.
Figure 2:
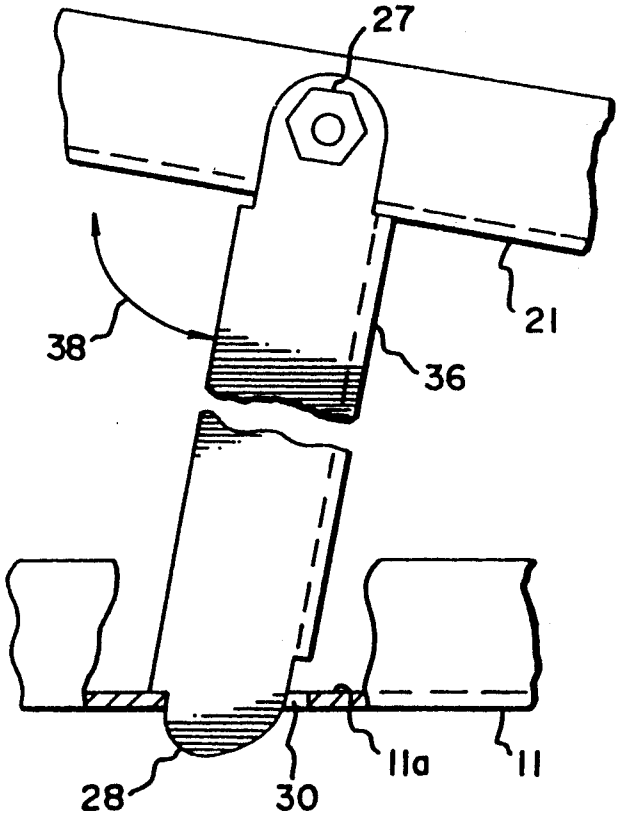

Referring now to FIGS. 2 and 3 along with FIG. 1, it can be seen that brace members 36, 36' are pivotally attached as shown by the double-headed arrow 38 in FIG. 2, to the side members 21, 21' at a preselected distance "y" from the first cross members 22, 22'. Preferably, each brace member is a unitary element of L-shaped cross section with an aperture in one end. The brace member is pivotally attached at the apertured one end to a respective one of the side members 21, 21' via an opening in that respective side member, and a nut and bolt assembly 27, the bolt of which extends through both the brace aperture and the side member opening. The other end of the brace member is provided with a protruding nose portion 28, the brace and the nose portion exhibiting a substantially vertical orientation throughout the entirety of the pivoting travel of the brace member.

Each of the side members 11,11' of frame unit 10 includes at least one pair of slots or elongated openings 30,30' in the horizontal flanges at the head supporting region. These elongated openings are located substantially below, yet forwardly, of the brace member pivots on the second frame unit 20.

When the brace members 36, 36' are pivoted into a position away from the second frame unit side members 21,21', they are placed in a desired pair of elongated slots such that the nose portions of the brace members are received in the slots. In this manner, the angular disposition of the mattress and boxsprings may be secured at a unique fixed angle of inclination relative to the first frame unit 10.

When it is not necessary for second frame 20 to be in a tilted position, the brace members 36, 36' may be folded back into adjacency with the side members 21,21', and the second frame unit, with boxsprings and mattress (not shown), may be lowered into the perimetrical confines of the first frame unit 10 to place the mattress and boxsprings in a horizontal orientation. In doing so, the second frame unit is completely hidden. The second frame unit 20 is returned to the inclined position by manually applying a lifting force to the headboard end cross arm 22 and/or 22' and simultaneously lowering the brace members and placing the nose portions in the desired pair of slots provided in the first frame unit side members 11,11'.

As with the known conventional bed frames, the cross arms 12,12' and 13,13' may be constructed with a vertically oriented flange disposed at the outer side of the horizontal flange. Two cross-arms for each side member may be attached by rivets to their respective side members so that the two fold together toward the side members for transportation and storage. Upon assembly, the cross arms can be unfolded, i.e., spread outwardly at 90 degree angles from the side members, fitted together, and then the two side members 11,11' (and/or 21,21') are moved inward or outward to the width desired and locked in place with metal nuts and bolts, the latter passing through the overlapped cross arms.

While the invention has been described with respect to the preferred embodiments thereof, it will be apparent that many modifications and alterations to the embodiments shown will occur to those skilled in the art upon reading and understanding the specification. It is intended that all such modifications and alterations or equivalents thereof be included within the scope of the appended claims.

What is claimed:

1. An improved mattress tilting assembly, said assembly comprising a first support frame including a pair of parallel elongated side members, each having a head-supporting end region and a foot-supporting end region, and a pair of cross members extending substantially normal to and interconnecting said side members, said side members and said cross members of said first support frame having substantially horizontal supporting surfaces defining a first support plane having a longitudinal axis; a second support frame including a pair of parallel elongated side members each having a head-supporting end region and a foot-supporting end region, and cross arms at each of said head-supporting and foot-supporting end regions, said cross arms extending between, and interconnecting, said second support frame side members, said side members and said cross arms of said second support frame having substantially horizontal supporting surfaces defining a second support plane; said first and second support frames being pivotally interconnected at pivot means spaced from the ends of the first support frame side members in the foot-supporting region; whereby said second support frame is movable from an horizontal position to an inclined position relative to said first support frame; said second support frame including at least one support brace having a pair of ends, pivot means connecting one end of said support brace to said second frame, vertically oriented nose portion means formed at the other end of said support brace, and slot means formed in said first support frame for receiving said nose portion means for holding said second frame in said inclined position.

2. A mattress tilting assembly comprising a first support frame and a second support frame having a head portion and a foot portion, means for positioning said second support frame at an angle to said first support frame for elevating said head portion relative to said foot portion, brace means carried by one of said support frames and including a vertically oriented nose portion, the other of said support frames including slot means therein for receiving said nose portion for holding said second support frame at said angle.

3. A mattress tilting assembly as defined in claim 2 wherein said brace means includes pivot means for pivotally connecting said brace means to said second support frame, said slot means being formed in said first support frame.

4. A mattress tilting assembly as defined in claim 3 including means for pivotally connecting said second support frame to said first support frame at a location remote from said brace means.

* * * * *